US007561121B2

(12) United States Patent
Denoyelle et al.

(10) Patent No.: US 7,561,121 B2
(45) Date of Patent: Jul. 14, 2009

(54) PRIMING METHOD IN A PLASMA PANEL

(75) Inventors: Pascal Denoyelle, Meylan (FR); Claude Meysen, Saint-Egrêve (FR); Hassane Guermoud, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 606 days.

(21) Appl. No.: 11/114,704

(22) Filed: Apr. 26, 2005 (Under 37 CFR 1.47)

(65) Prior Publication Data

US 2005/0270253 A1 Dec. 8, 2005

(30) Foreign Application Priority Data

Apr. 26, 2004 (FR) ..... 04 04409

(51) Int. Cl.
*G09G 3/28* (2006.01)

(52) U.S. Cl. ..... 345/60; 345/65; 345/72

(58) Field of Classification Search ..... 345/60–65, 345/76, 72, 74.1, 75.1, 75.2, 214, 215, 169.4; 315/169.3, 169.4; 313/486, 582
See application file for complete search history.

(56) References Cited

U.S. PATENT DOCUMENTS 5,745,086 A 4/1998 Weber
7,109,662 B2 * 9/2006 Sakita ..... 315/169.3
7,164,394 B2 * 1/2007 Hirose et al. ..... 345/60
7,212,177 B2 * 5/2007 Kanazawa et al. ..... 345/63
7,412,088 B2 * 8/2008 Kuramata et al. ..... 382/141
2002/0130823 A1 9/2002 Takayama

FOREIGN PATENT DOCUMENTS

EP 0 961 258 A1 12/1999

OTHER PUBLICATIONS

Search Report

* cited by examiner

*Primary Examiner*—Abbas I Abdulselam
(74) *Attorney, Agent, or Firm*—Robert D. Shedd; Joseph J. Opalach; Reitseng Lin

(57) ABSTRACT

The present invention relates to a priming method in the cells of a plasma display panel and a device implementing said method. In a plasma display panel, each cell is provided with at least two electrodes and one type of phosphor out of at least two types is associated with each of the cells to determine the color of the light emitted by the cell. Priming consists in applying a voltage greater than a threshold voltage between the electrodes of the cells. Since the threshold voltage above which electrical charges are created in the cell is different according to the type of phosphor of the cell, it is proposed according to the invention to use, to create the charges in the cells, a voltage that differs according to the type of phosphor so as to create only the electrical charges needed in the cells.

20 Claims, 4 Drawing Sheets

PRIMING METHOD IN A PLASMA PANEL

This application claims the benefit, under 35 U.S.C. § 119 of French Patent Application 0404409, filed Apr. 26, 2004.

FIELD OF THE INVENTION

The present invention relates to a method of priming the cells of a plasma display panel and a device implementing said method. This method is more particularly applicable to colour display devices comprising a memory effect alternating current type plasma panel, with crossed electrodes used at least for addressing, where appropriate provided with coplanar electrodes used at least for sustain purposes, and means of driving this panel designed to carry out reset, addressing and sustain operations in the discharge zones of this panel.

BACKGROUND OF THE INVENTION

A memory effect alternating current plasma display panel (PDP) normally comprises two parallel plates enclosing a space containing a discharge gas; between the plates, normally on the internal surfaces of these plates, such a panel has a number of electrode arrays:

- normally two arrays of crossed, non-coplanar electrodes, each positioned on a different plate, used for addressing the discharges, and at the intersections of which luminous discharge zones are defined within the space between the plates,
- and at least two arrays of parallel coplanar electrodes, positioned on the same plate and used to sustain the discharges; these arrays are coated with a dielectric layer, in particular to add a memory effect; this dielectric layer is itself coated with a secondary protection and electron emission layer, normally based on magnesium oxide.

Each electrode of one sustain array forms with an electrode of the other sustain array a pair of electrodes delimiting between themselves a succession of luminous discharge zones, normally distributed along a row of discharge zones of the panel. The luminous discharge zones form, on the panel, a two-dimensional matrix; each zone is designed to emit light so that the matrix displays the picture to be viewed.

Normally, one of the coplanar electrode arrays is used for both addressing and sustaining. In this particular case, $Y_{as}$ will be used to denote this electrode array, $Y_a$ to denote the second array of coplanar electrodes and X to denote the array of addressing electrodes at right angles to $Y_{as}$ and $Y_a$ and positioned on the other plate. The electrode arrays $Y_a$ and $Y_{as}$ therefore serve rows of discharge zones, whereas the electrode array X used only for addressing serves columns of discharge zones.

The adjacent discharge zones, at least those that emit different colours, are normally delimited by barriers; these barriers are normally used as spacers between the plates. In the description that follows, each luminous discharge zone of the panel is called a cell.

The walls of the cells are normally partially coated with phosphors sensitive to the ultraviolet radiation of the luminous discharges. Adjacent cells are provided with phosphors emitting different primary colours, so that the combination of three adjacent cells forms a picture element or pixel. In practice, these phosphors cover the sides of the barriers and the plate bearing these barriers, which is normally the plate bearing the electrode array used only for addressing; the addressing electrodes are therefore covered with phosphors.

When the plasma panel is in operation, to display an image, a succession of displays or sub-displays is carried out using the cell matrix; each sub-display generally comprises the following steps:

- firstly, a selective addressing step, the purpose of which is to modify the electrical charges on the dielectric layer in each of the cells to be activated, by applying at least one voltage pulse between the addressing electrodes of these cells,
- then, a non-selective sustain step during which a succession of voltage pulses is applied between the electrodes of the sustain pairs to provoke a succession of luminous discharges only in the cells that have previously been activated.

At the end of a sub-display, the cells can be in very different internal electrical voltage states, in particular depending on whether they have been activated in this sub-display; other factors contribute to this spread of internal voltage states, such as the nature of the phosphors corresponding to these cells, the inevitable fluctuations of the dimensional characteristics of these cells, the fluctuations of surface composition of the walls of these cells, which are linked to the panel production methods.

To make the states of the internal voltages of the cells to be addressed uniform, most of the addressing steps are preceded by an equalization step, the main purpose of which is to reset all the cells to be addressed to one and the same internal voltage state, whether or not they have been activated during the preceding sub-display; this equalization, or "reset", step conventionally comprises an electrical charge-forming operation, or "priming" operation, followed by a charge adjustment operation, also called "erasure" of these charges at the end of which, ideally, the internal voltages within each cell are close to the firing thresholds between addressing electrodes and between sustain electrodes.

For each pair of addressing or sustain electrodes of a cell, an external voltage applied between these electrodes can be associated with an internal voltage in the gas space separating the materials that cover these electrodes. The internal voltage normally differs from the external voltage because of the surface charges that are found on the surface of the insulating materials covering the electrodes, at the interface between these dielectric materials and the gas of the cell. These surface charges result on the one hand from a capacitive effect linked to the dielectric properties of the materials that delimit the cells and on the other hand from an accumulation of "memory" charges produced by the preceding discharges in the gas of these cells.

The internal firing threshold of a cell in a given direction corresponds to a limiting internal voltage value along this direction above which the gas is ionized within this cell. This value depends on the characteristics of the gas in this cell, on those of the materials in contact with the gas in this cell, and on the geometry of the electrodes crossing this cell on the outside of this cell.

In the particular case described previously of three arrays $Y_a$, $Y_{as}$ and X of electrodes, six internal threshold values are normally associated with each cell:

- an internal firing threshold between $Y_a$ anode and $Y_{as}$ cathode: $T[Y_a_Y_{as}]$
- an internal firing threshold between $Y_a$ cathode and $Y_{as}$ anode: $T[Y_{as}_Y_a]$
- an internal firing threshold between $Y_a$ anode and X cathode: $T[Y_a_X]$
- an internal firing threshold between $Y_a$ cathode and X anode: $T[X_Y_a]$ an internal firing threshold between $Y_{as}$ anode and X cathode: $T[Y_{as}_X]$ an internal firing threshold between $Y_{as}$ cathode and X anode: $T[X_Y_{as}]$ The terms anode and cathode are relative to the internal potentials in the gas of a cell in the vicinity of the electrodes crossing that cell: one electrode is said to be in anode mode relative to another if the potential in its vicinity in the gas is greater than that in the vicinity of the other electrode, this other electrode then being relatively in cathode mode.

The following two internal thresholds have the same value because they characterize discharges in coplanar mode which are generated by electrodes supported by the same plate and normally positioned symmetrically relative to each other:

$$T[Y_a_Y_{as}]=T[Y_{as}_Y_a]$$

The following two internal thresholds, which characterize the discharges in matrix mode, therefore between two different plates, are, however, different depending on whether the electrode concerned is acting as an anode or a cathode:

$$T[Y_a_X]=T[Y_{as}_X]$$

$$T[X_Y_a]=T[X_Y_{as}]$$

In practice, when the column addressing electrode X is in cathode mode, the secondary emission of the phosphor covering it being lower than that of the magnesium on the surface of the dielectric covering the row electrode $Y_a$ or $Y_{as}$, the discharges occur at higher voltages than when it is in anode mode.

Normally:

during a priming operation, each electrode of the array $Y_{as}$ used for both addressing and sustain functions is in anode mode relative to the other two electrodes of the arrays $Y_a$ and X;

during an erasure operation, with each electrode used for both addressing and sustain functions, $Y_{as}$ is in cathode mode relative to the other two electrodes $Y_a$ and X.

These operations are normally performed by applying a slowly increasing potential difference on the one hand between the two coplanar sustain electrodes and on the other hand between the two matrix addressing electrodes of all the cells of a group to be addressed; the documents FR 2417848 (THOMSON-1978) and U.S. Pat. No. 5,745,086 (PLASMACO-1998) thus describe the application of ramped voltage signals to the electrode or the electrodes used for both addressing and sustain functions while a constant voltage signal is applied to the other addressing-only and sustain-only electrodes.

U.S. Pat. No. 5,745,086 discloses that the reset operations of the cells of a panel are thus performed, advantageously, in each cell, without strong discharge but with a series of "weak" discharges between the electrodes when the slope of the ramp signal applied does not exceed 10 V/μs. These "weak" discharges compensate for the increase in external voltage applied to the electrodes by depositing surface charges on the walls of the cells served by these electrodes, and, since there is no "strong" discharge, the internal voltage in the gas of these cells therefore remains equal to or slightly less than the internal firing threshold defined previously.

The known advantages of reset by weak discharges, also called "positive resistance equalization", are to enable a precise adjustment of the internal electrical voltages within the cells by producing a weak luminous emission. The precise adjustment is essential to the performance and the effectiveness of the subsequent addressing operation. Limiting this light emission is essential to the contrast performance of the display device.

During the priming operations, electrical discharges occur between the electrodes $Y_{as}$ and X of the cells in the direction $X \rightarrow Y_{as}$. These discharges must take place whatever the nature of the phosphor in the cell. However, the phosphors normally have poor secondary emission properties compared to the magnesium oxide that covers the rows. These secondary emission properties are, moreover, highly variable according to the phosphor used. It is, in particular, commonplace for the secondary emission properties of the green phosphors to fall below those of the red and blue phosphors.

The result is that the condition for producing discharges between the electrodes X and $Y_{as}$ in each cell is translated differently in terms of external voltage to be applied according to the nature of the phosphor associated with said cell:

for the phosphors with poor secondary emission coefficient, the threshold voltage is high; therefore, independently of other phenomena, a higher voltage must be applied between the electrodes $Y_{as}$ and X to provoke discharges between these electrodes;

for the phosphors having a better secondary emission coefficient, the voltage to be applied can be weaker.

Currently, the voltage signals applied, during the priming operation, to the electrodes $Y_{as}$ and X of the cell are independent of the nature of the phosphor of the cells. The same voltage signals are applied to the electrodes X and $Y_{as}$ of the green, red and blue cells. The voltage level of the signals applied is determined to ensure that an adequate electrical charge transfer takes place in all the cells, even the cells for which the phosphor presents a weak secondary emission coefficient. This case is illustrated in FIG. 1. This figure represents the voltage signals applied to the electrodes X and $Y_{as}$ of the cells during the priming phase on the internal walls of the cells. These signals are identical regardless of the phosphor (green, red or blue) of the cell. An increasing voltage ramp is applied to the electrode $Y_{as}$ of the cells. The threshold voltage needed for priming on the internal walls of the cells varies according to the phosphor used. In the example of FIG. 1, the threshold voltage $S_B$ of the blue cells is slightly greater than that of the red cells $S_R$. Moreover, the threshold voltage of the green cells $S_G$ is very much greater than those of the blue and red cells. The voltage difference between the thresholds of the red and green cells is denoted $E_1(=S_G-S_R)$ and that between the blue and green cells $(=S_G-S_B)$ is denoted $E_2$. These differences can be as high as 60 volts for $E_1$ and 50 volts for $E_2$. A zero voltage is, moreover, applied to the electrode X of the cells. The priming in the cells is illustrated in FIG. 1 by the presence of the relevant electrical discharges.

Since the same voltage ramp is applied to the blue, red and green cells, discharges occur earlier in the red and blue cells than in the green cells. These discharges continue until the end of the voltage ramp. The result is an excess of discharges in the blue and red cells which unnecessarily increases the background light level (light emitted in the absence of any video content) associated with the priming operation in the cells. This excess of background light is prejudicial to contrast. Furthermore, an excess of discharges between the electrodes X and $Y_{as}$ with the electrode X in cathode mode also represents an additional cause of degradation of the phosphors because, in this discharge mode, it is ions that bombard the phosphors.

SUMMARY OF THE INVENTION

An object of the invention is to propose a method for ensuring an adequate transfer of charges from the electrodes X to the electrodes $Y_{as}$ regardless of the type of phosphor of the cell.

According to the invention, it is proposed to reduce, or even cancel, this excess of discharges by applying a voltage to the electrode X of the cells, this voltage being dependent on the phosphor of the cell.

Also, the invention relates to a priming method in the cells of a plasma display panel, each cell being provided with at least two electrodes and one type of phosphor out of at least two types being associated with each of the cells to determine the colour of the light emitted by said cell, said method consisting in applying a voltage greater than a threshold voltage between the electrodes of each of said cells to create electrical charges in the latter, the threshold voltage from which the electrical charges are created in the cell being different according to the type of phosphor of the cell, wherein the voltage applied between the electrodes of the cells to create electrical charges is different for at least two of the types of phosphor.

A different voltage is used for at least two phosphors to reduce, for at least one of these phosphors, the excess of electrical charges created.

To create said voltage between the electrodes of a cell, a first voltage signal is applied to the electrode $Y_{as}$ of the cell and a second voltage signal to the electrode X. The first voltage signal is identical whatever the type of phosphor of the cell and the second voltage signal is different for at least two of the phosphor types. The first voltage signal comprises a voltage ramp followed by a voltage level, the maximum amplitude of which is greater than the highest threshold voltage of the phosphors.

According to the invention, the second voltage signal is, for the phosphor having the highest threshold voltage, a zero voltage whatever the embodiment.

According to a first embodiment, for the phosphors other than the one having the highest threshold voltage, the second signal is a voltage pulse active during said first voltage signal and the amplitude of which is equal to the voltage difference between the threshold voltage associated with said phosphor and the highest threshold voltage.

According to a second embodiment, the second voltage signal for a phosphor other than the phosphor having the highest threshold voltage is a voltage pulse active during said first voltage signal and the amplitude of which is equal to the smallest difference between the highest threshold voltage and the threshold voltages associated with the phosphors other than the one having the highest threshold voltage.

As a variant, the second voltage signal for a phosphor other than the phosphor having the highest threshold voltage is a voltage pulse active during said first voltage signal and the amplitude of which is equal to the addressing voltage $V_{data}$ of the cells, the maximum amplitude of the voltage ramp being determined to ensure that there are sufficient electrical charges created in each of the cells.

According to another embodiment, the second voltage signal for a phosphor other than the phosphor having the highest threshold voltage is a voltage pulse active during a final part of said first voltage signal and the amplitude of which is at least equal to the voltage difference between its threshold voltage and the maximum amplitude of said voltage ramp, the start of the pulse occurring when a sufficient quantity of electrical charges has been created in the cell.

The pulses applied to the cells having a phosphor other than the phosphor having the highest threshold voltage may be identical, if necessary, to reduce the number of voltage levels to be produced in the column driver circuits of the panel. The amplitude of said pulses is, for example, equal to the maximum voltage difference between the threshold voltage of the phosphors other than the phosphor having the highest threshold voltage and the maximum amplitude.

BRIEF DESCRIPTION OF THE DRAWINGS

The invention will be better understood on reading the description that follows, given by way of nonlimiting example, and with reference to the appended figures in which.

DESCRIPTION OF PREFERRED EMBODIMENTS

The invention proposes applying a voltage between the electrodes $Y_{as}$ and X of the cell which is different according to the type of phosphor of the cell. The voltage applied is defined to reduce the unnecessary discharges in the cells.

The method of the invention will be described in the context of a display panel including cells of three colours, red, green and blue. As a general rule, it is applicable to panels having at least two types of phosphor.

Figure 1:
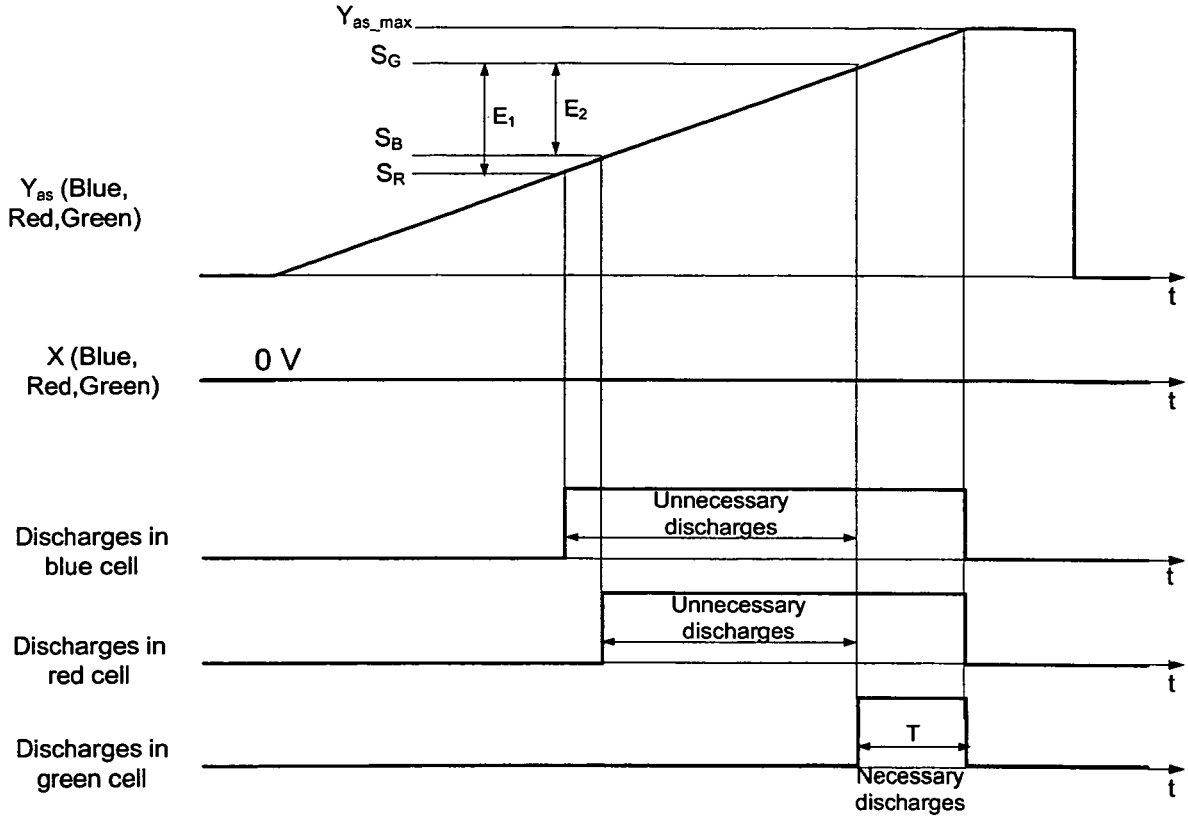
FIG.1 (Prior art)
FIG. 1 represents the voltage signals applied conventionally to the electrodes X and $Y_{as}$ of the cells of the panel and the resulting electrical discharges in the cells.

As described with reference to FIG. 1, the threshold voltage $S_G$ of the green cells is greater than that of the blue cells $S_B$, which is in turn greater than the threshold voltage $S_R$ of the red cells.

Figure 2:
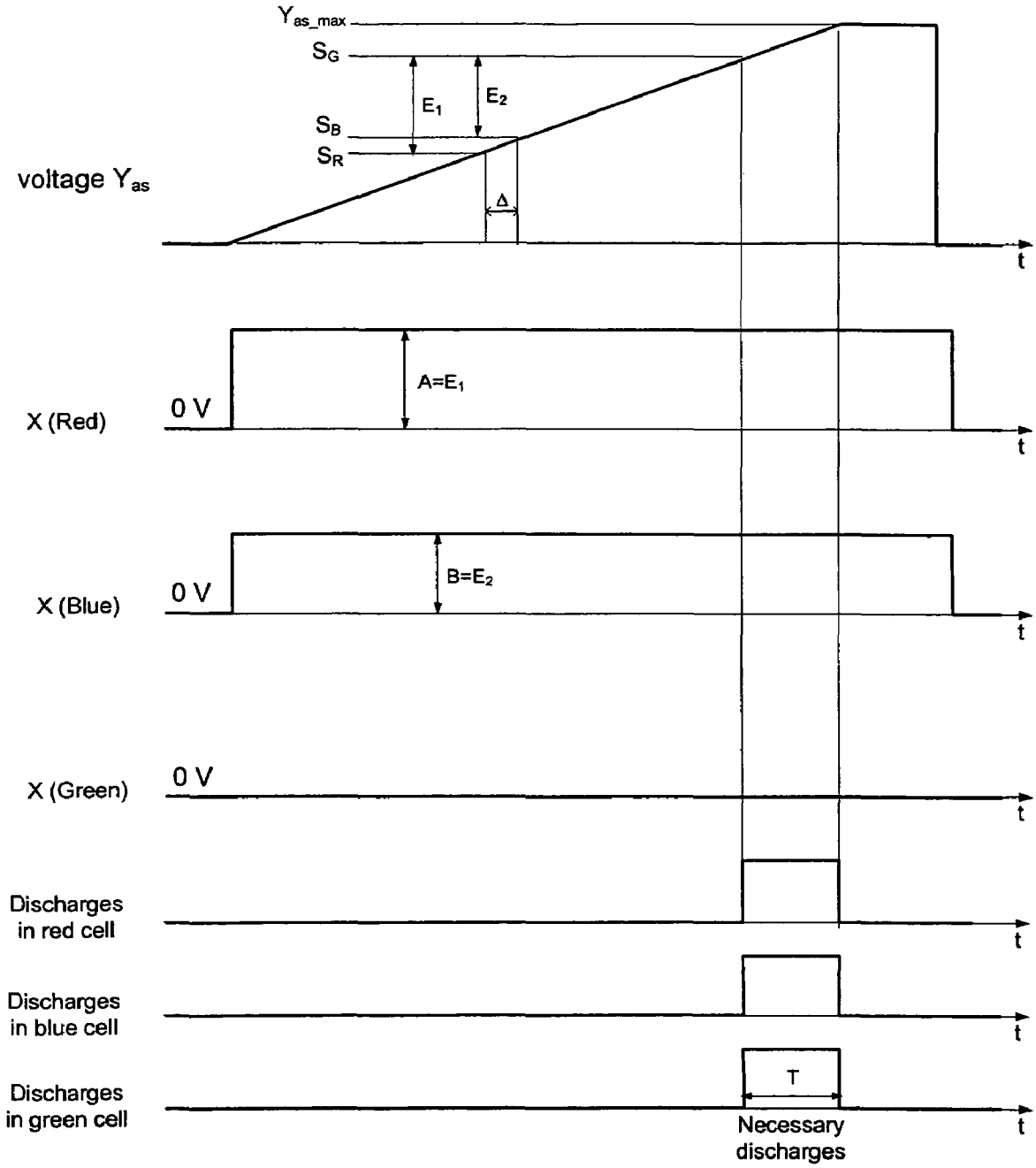
FIG. 2 represents the voltage signals applied to the electrodes X and $Y_{as}$ of the cells of the panel according to a first embodiment of the invention and the resulting electrical discharges in the cells.

According to a first embodiment of the invention illustrated by FIG. 2, to reduce the number of unnecessary electrical discharges in the red and blue cells, the triggering of the discharges in the cells is delayed by applying a positive voltage pulse to the electrode X during the cell "priming" phase. The amplitude of this pulse is at least equal, for the red cells, to the difference $E_1$ between the threshold voltages $S_G$ and $S_R$ and, for the blue cells, to the difference $E_2$ between the threshold voltages $S_G$ and $S_B$. FIG. 2, by comparison with FIG. 1, shows the voltage signals applied to the electrodes $Y_{as}$ and X of the cells of the panel during the priming phase and the relevant electrical discharges.

A voltage ramp followed by a voltage level are applied to the electrode $Y_{as}$ of the red, green and blue cells. This ramp is identical to that of FIG. 1. It advantageously presents a relatively weak slope to ensure that the discharges, when they occur, are in "weak discharge" mode as described in patent U.S. Pat. No. 5,745,086. A voltage pulse of amplitude $A=E_1$ is applied to the electrode X of the red cells active during said ramp and said voltage level. The voltage pulse is preferably cancelled shortly after the end of the voltage level to avoid too great a voltage drop between the electrodes X and $Y_{as}$ at the end of the latter.

Similarly, a voltage pulse of amplitude $B=E_2$ is applied to the electrode X of the blue cells. It is active during said ramp and said voltage level and is cancelled preferably shortly after the end of the voltage level for the reason cited previously. No pulse is applied to the electrode X of the green cells.

The result of this is electrical discharges in the three types of cell that are simultaneous (at end of voltage ramp above the threshold $S_G$) and in equal quantities. The maximum value of the voltage ramp, denoted $Y_{as_max}$, is, where appropriate, regulated to ensure that there are sufficient electrical charges created in each of the cells. T denotes the time needed to obtain an adequate transfer of charges between the electrodes X and $Y_{as}$ of the cells.

Figure 3:
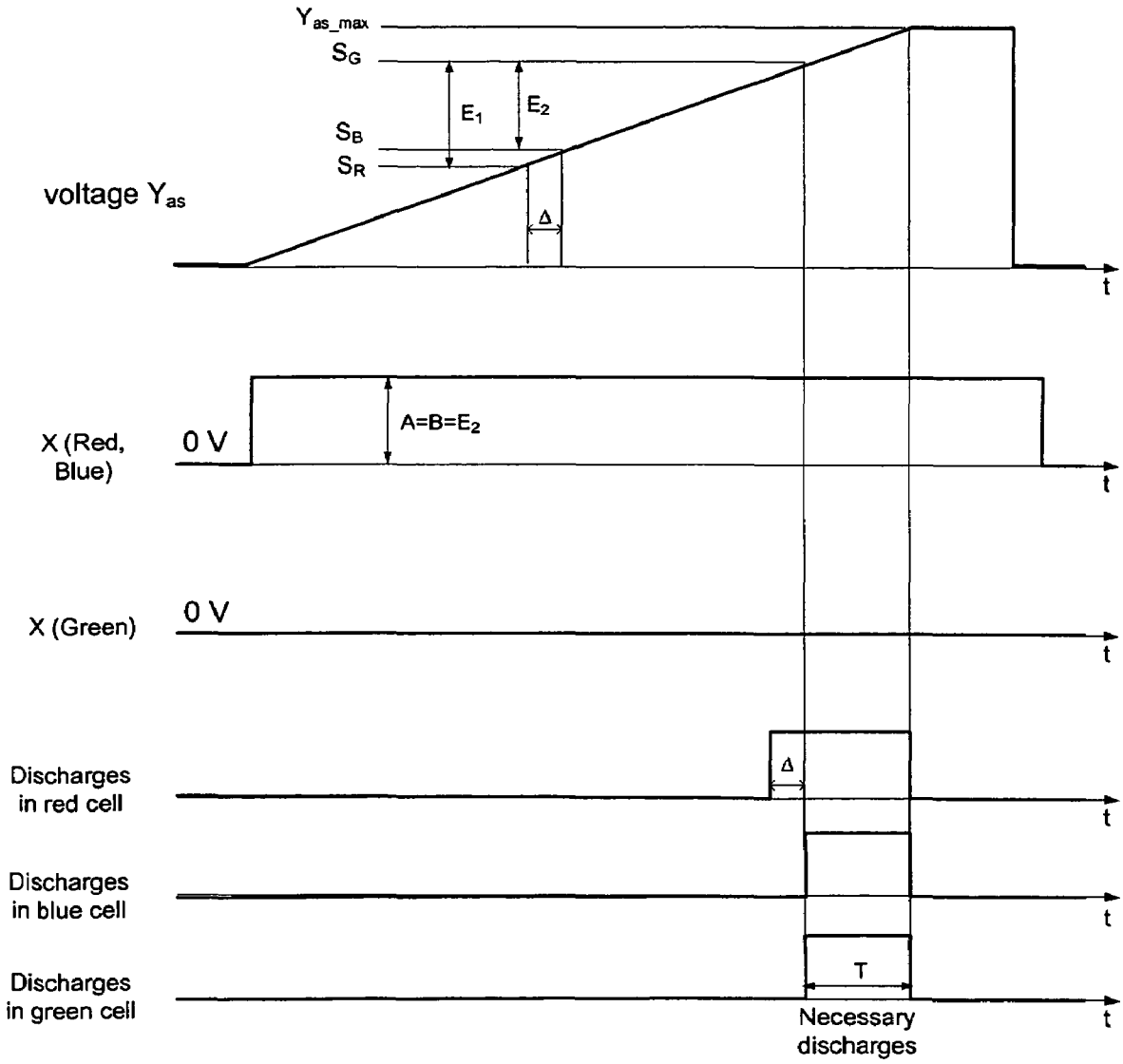
FIG. 3 represents the voltage signals applied to the electrodes X and $Y_{as}$ of the cells of the panel according to a second embodiment of the invention and the resulting electrical discharges in the cells.

In practice, the voltage pulses applied to the electrodes X are produced by the column driver circuits of the panel. These driver circuits are normally powered between a zero voltage (0 volts) and a voltage Vdata corresponding to the cell addressing voltage. To avoid having to generate too many different voltage levels in the column driver circuits, a second embodiment is proposed in FIG. 3.

In this second embodiment, pulses of the same amplitude are applied to the electrodes X of the blue and red cells. This embodiment then requires only a single additional voltage level in the column driver circuits. The amplitude A and B of the voltage pulses on the electrodes X of the blue and red cells is advantageously equal to $E_2$ which corresponds to the smaller of the two differences $E_1$ and $E_2$. Discharges are then obtained in the blue and green cells during the time T and during a time T+Δ in the red cells. The amplitudes A and B can, if appropriate, be adjusted to a different value (greater than or less than $E_2$) and then $Y_{as_max}$ can be adjusted to obtain a sufficient quantity of discharges (time T) in all the cells. In this case, at best one of the types of phosphors presents precisely the quantity of discharges needed in its cells (that is, discharges during a time T).

In this latter case, A and B can advantageously be adjusted to Vdata to avoid having to generate voltage levels other than Vdata in the column driver circuits. Currently, there are phosphors such that $E_1$=60 volts and $E_2$=50 volts and column driver circuits in which Vdata is approximately 65 volts. The maximum voltage $Y_{as_max}$ of the ramp is, moreover, approximately 400 volts. It is assumed that A=B=Vdata and the value $Y_{as_max}$ is adjusted for the quantity of discharges in each of the cells to be sufficient.

According to a third embodiment, voltage pulses are applied to the electrodes X of the blue and red cells as in the first and second embodiments, but these pulses are applied at different moments. This embodiment is illustrated in FIG. 4.

In this fourth embodiment, the voltage pulses are used to stop the electrical discharges in the red and blue cells. $E_3$ denotes the voltage difference between $Y_{as_max}$ and $S_R$ and $E_4$ denotes the voltage difference between $Y_{as_max}$ and $S_B$. According to this embodiment, the voltage pulses on the electrodes X of the blue and red cells are produced when a sufficient quantity of charges transferred between the electrodes X and $Y_{as}$ is reached. To stop the transfer, the pulse must have an amplitude at least equal to $E_3$ in the case of the red cells and at least equal to $E_4$ in the case of the blue cells.

Figure 4:
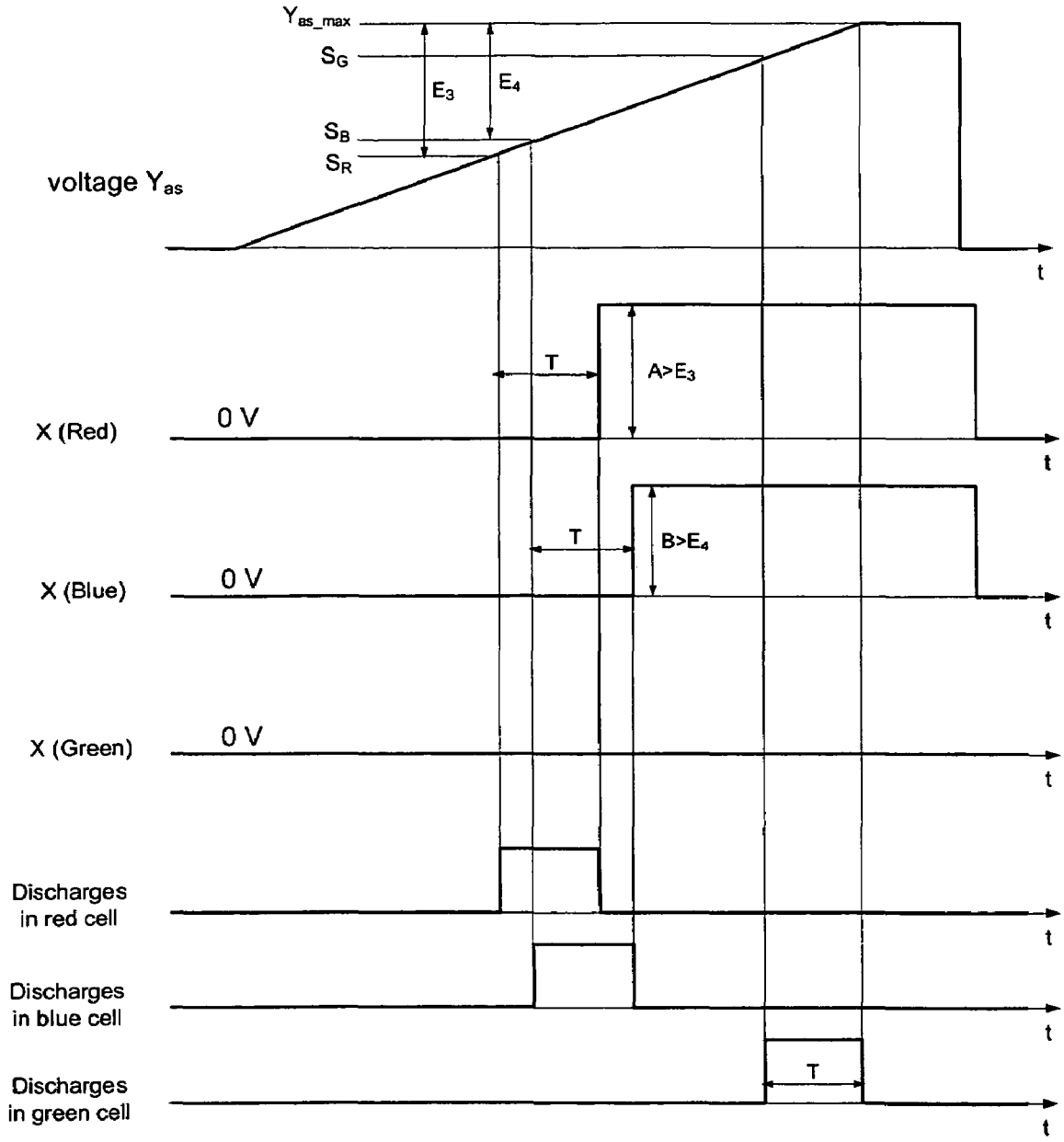
FIG. 4 represents the voltage signals applied to the electrodes X and $Y_{as}$ of the cells of the panel according to a third embodiment of the invention and the resulting electrical discharges in the cells.

In the example of FIG. 4, the voltage pulse for the red cells is triggered after a time interval of duration T after the voltage on its electrode $Y_{as}$ has reached the threshold $S_R$ and, for the blue cells, after a time interval of duration T after the voltage on its electrode $Y_{as}$ has reached the threshold $S_B$. The pulse is maintained until the end of the voltage level. As for the embodiments described previously, the pulse is preferably cancelled shortly after the end of the voltage level to avoid too great a voltage drop between the electrodes X and $Y_{as}$ at the end of the latter.

In this embodiment, the discharges do not therefore occur simultaneously in the red, green and blue cells.

This embodiment enables the quantity of electrical charges transferred for each colour to be adjusted independently. It is possible to trigger the voltage pulse after a time that can be greater than T.

Advantageously, A=B can be taken so as to have to produce only a single additional voltage level in the column driver circuits. To stop the discharges in the blue and red cells, this common level must at least be equal to the highest difference between $E_3$ and $E_4$, in this case $E_3$.

The invention claimed is:

1. A method of priming cells of a plasma display panel, said cells including first cells and second cells and each said cell having at least two electrodes, said first cells being associated with a first type of phosphor corresponding to a first color of light emitted by said first cells and said second cells being associated with a second type of phosphor corresponding to a second color of light emitted by said second cells, said method comprising:

applying a first voltage between the electrodes of said first cells to create electrical charges in said first cells, said first voltage being greater than a first threshold voltage which depends on said first type of phosphor; and applying a second voltage between the electrodes of said second cells to create electrical charges in said second cells, said second voltage being greater than a second threshold voltage which depends on said second type of phosphor, said first and second voltages being different.

2. The method according to claim 1, wherein, for each said cell, a first voltage signal is applied to a first one of the electrodes of the cell and a second voltage signal is applied to a second one of the electrodes of the cell, and wherein said first voltage signal is identical whatever the type of phosphor of the cell and said second voltage signal is different for at least two different types of phosphors.

3. The method according to claim 2, wherein said first voltage signal comprises a voltage ramp followed by a voltage level, a maximum amplitude of which is greater than a highest threshold voltage of the phosphors.

4. The method according to claim 3, wherein the second voltage signal for one of the phosphors other than the phosphor having the highest threshold voltage is a voltage pulse active during said first voltage signal and an amplitude of which is equal to an addressing voltage of the cells, the maximum amplitude of the voltage ramp being determined to ensure that there are sufficient electrical charges created in each of the cells.

5. The method according to claim 3, wherein the second voltage signal for one of the phosphors other than the phosphor having the highest threshold voltage is a voltage pulse active during a final part of said first voltage signal an amplitude of which is at least equal to a voltage difference between its threshold voltage and the maximum amplitude of said voltage ramp, a start of the pulse occurring when a sufficient quantity of electrical charges has been created in the cell.

6. The method according to claim 5, wherein pulses applied to the cells having one of the phosphors other than the phosphor having the highest threshold voltage are identical.

7. The method according to claim 6, wherein an amplitude of said pulses is equal to a maximum voltage difference between a threshold voltage of the phosphors other than the phosphor having the highest threshold voltage and the maximum amplitude.

8. The method according to claim 5, wherein the cells of the plasma display panel include three different types of phosphors.

9. The method according to claim 2, wherein the second voltage signal for the phosphor having a highest threshold voltage is a zero voltage.

10. The method according to claim 9, wherein the second voltage signal for one of the phosphors other than the phosphor having the highest threshold voltage is a voltage pulse active during said first voltage signal and an amplitude of which is equal to a voltage difference between the highest threshold voltage and a threshold voltage associated with said phosphor.

11. The method according to claim 9, wherein the second voltage signal for one of the phosphors other than the phosphor having the highest threshold voltage is a voltage pulse active during said first voltage signal and an amplitude of which is equal to a smallest difference between the highest threshold voltage and threshold voltages associated with the phosphors other than the one having the highest threshold voltage.

12. A device for priming cells of a plasma display panel, said cells including first cells and second cells and each said cell having at least two electrodes, said first cells being associated with a first type of phosphor corresponding to a first color of light emitted by said first cells and said second cells being associated with a second type of phosphor corresponding to a second color of light emitted by said second cells, wherein:

a first voltage is applied between the electrodes of said first cells to create electrical charges in said first cells, said first voltage being greater than a first threshold voltage which depends on said first type of phosphor; and a second voltage is applied between the electrodes of said second cells to create electrical charges in said second cells, said second voltage being greater than a second threshold voltage which depends on said second type of phosphor, said first and second voltages being different.

13. The device according to claim 12, wherein, for each said cell, a first voltage signal is applied to a first one of the electrodes of the cell and a second voltage signal is applied to a second one of the electrodes of the cell, and wherein said first voltage signal is identical whatever the type of phosphor of the cell and said second voltage signal is different for at least two different types of phosphors.

14. The device according to claim 13, wherein said first voltage signal comprises a voltage ramp followed by a voltage level, a maximum amplitude of which is greater than a highest threshold voltage of the phosphors.

15. The device according to claim 14, wherein the second voltage signal for one of the phosphors other than the phosphor having the highest threshold voltage is a voltage pulse active during said first voltage signal and an amplitude of which is equal to an addressing voltage of the cells, the maximum amplitude of the voltage ramp being determined to ensure that there are sufficient electrical charges created in each of the cells.

16. The device according to claim 14, wherein the second voltage signal for one of the phosphors other than the phosphor having the highest threshold voltage is a voltage pulse active during a final part of said first voltage signal an amplitude of which is at least equal to a voltage difference between its threshold voltage and the maximum amplitude of said voltage ramp, a start of the pulse occurring when a sufficient quantity of electrical charges has been created in the cell.

17. The device according to claim 16, wherein pulses applied to the cells having one of the phosphors other than the phosphor having the highest threshold voltage are identical.

18. The device according to claim 13, wherein the second voltage signal for the phosphor having a highest threshold voltage is a zero voltage.

19. The device according to claim 18, wherein the second voltage signal for one of the phosphors other than the phosphor having the highest threshold voltage is a voltage pulse active during said first voltage signal and an amplitude of which is equal to a voltage difference between the highest threshold voltage and a threshold voltage associated with said phosphor.

20. The device according to claim 18, wherein the second voltage signal for one of the phosphors other than the phosphor having the highest threshold voltage is a voltage pulse active during said first voltage signal and an amplitude of which is equal to a smallest difference between the highest threshold voltage and threshold voltages associated with the phosphors other than the one having the highest threshold voltage.

* * * * *